US006138298A

United States Patent [19]

Ball

[11] Patent Number: 6,138,298

[45] Date of Patent: Oct. 31, 2000

[54] CLIP ON FLUID OVERFLOW PLATE FOR BATHTUBS

[75] Inventor: William T. Ball, Leawood, Kans.

[73] Assignee: WCM Industries, Inc., Colorado Springs, Colo.

[21] Appl. No.: 09/259,767

[22] Filed: Mar. 1, 1999

[51] Int. Cl.[7] ..... E03C 1/042

[52] U.S. Cl. ..... 4/694

[58] Field of Search ..... 4/694, 680; 285/46; D23/254

[56] References Cited

U.S. PATENT DOCUMENTS 1,235,387 7/1917 Serper ..... 4/694
3,121,879 2/1964 Young ..... 4/694
5,025,509 6/1991 Holt et al. ..... 4/694
5,123,123 6/1992 Hart et al. ..... 4/684

*Primary Examiner*—Charles E. Phillips
*Attorney, Agent, or Firm*—Zarley, McKee, Thomte, Voorhees & Sease

[57] ABSTRACT

An overflow plate assembly for tubs has an outlet port associated with a drain pipe. A mounting plate is secured to the port. A first fluid overflow plate has an inner and outer surface. The first overflow plate is secured to a mounting plate on the port by a screw or the like. The first mounting plate has a fluid inlet opening in its bottom portion. A second overflow plate has an upstanding clip on its lower inner surface then extends upwardly through the inlet opening of the first overflow plate to detachably clip the second overplate to the outer surface of the first overflow plate.

4 Claims, 2 Drawing Sheets

CLIP ON FLUID OVERFLOW PLATE FOR BATHTUBS

BACKGROUND OF THE INVENTION

Every modern bathtub has an overflow outlet to prevent the water level in the tub from overflowing in the event that the inlet faucet is inadvertently left in an open position. The overflow outlet is connected to the conventional drain system for the tub and is typically located at an elevated position at the end of the tub. The overflow outlet normally has a mounting plate associated therewith, and an overflow plate is secured to the mounting plate by screws or the like.

As a result, the installation of the overflow plate requires the use of one or more screws and a screw driver, which always must be used to install or replace the overflow plate.

It is therefore a principal object of the invention to provide an overflow plate that can be easily installed or removed without having to use special tools or fastening means such as screws.

A further object of this invention is to provide an overflow plate that can be detachably clipped to an existing overflow plate.

These and other objects will be apparent to those skilled in the art.

SUMMARY OF THE INVENTION

An overflow plate assembly for tubs has an outlet port associated with a drain pipe. A mounting plate is secured to the port. A first fluid overflow plate has an inner and outer surface. The first fluid overflow plate is secured to a mounting plate on the port by a screw or the like. The first mounting plate has a fluid inlet opening in its bottom portion. A second overflow plate has an upstanding clip on its lower inner surface then extends upwardly through the inlet opening of the first overflow plate to detachably clip the second overplate to the outer surface of the first overflow plate.

DESCRIPTION OF THE PREFERRED EMBODIMENT

Figure 1:
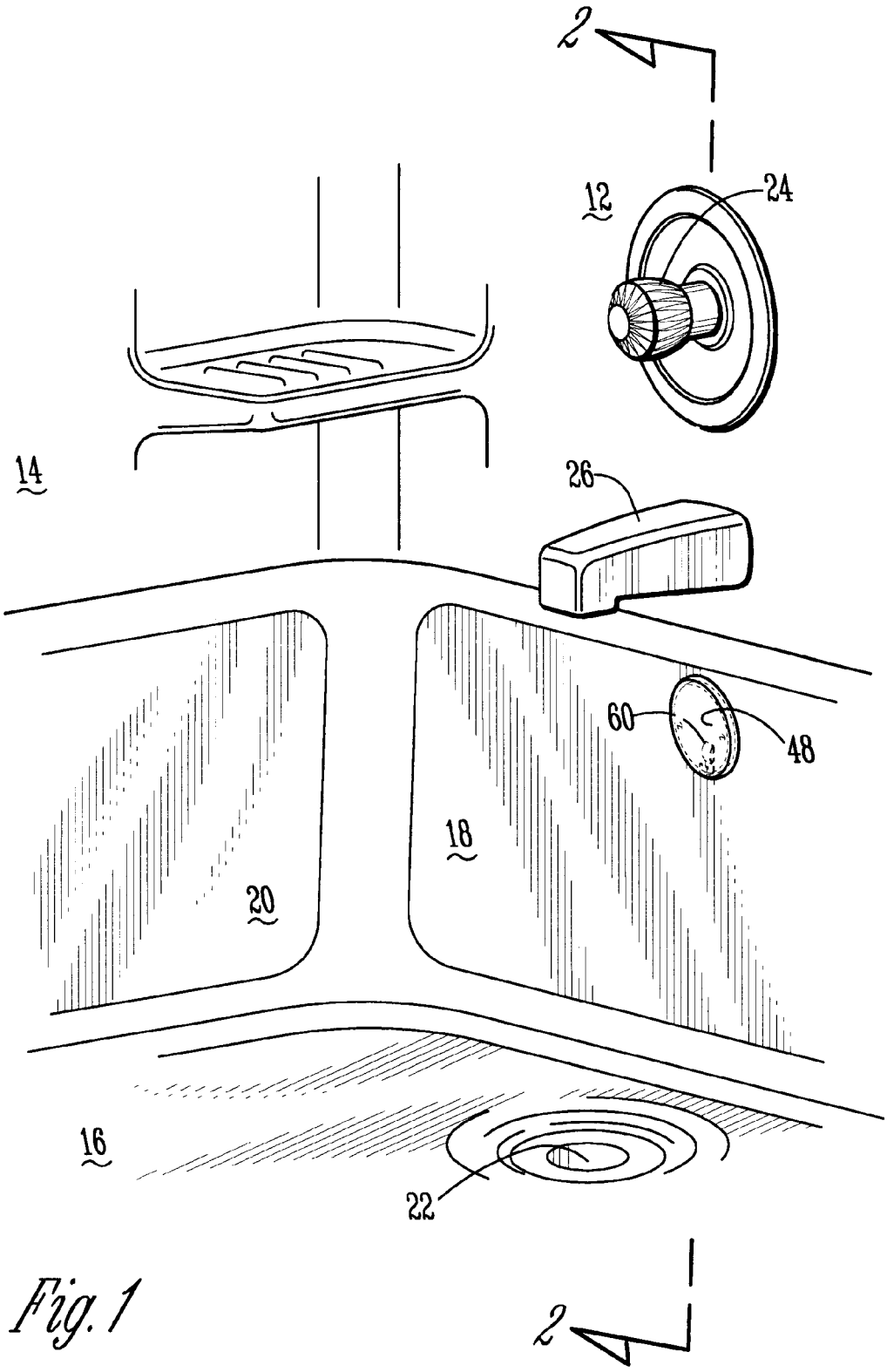
FIG. 1 is a partial perspective view of a tub having the overflow plate assembly of the invention.

A bathtub ("tub") 10 is mounted adjacent bathroom end wall 12 and sidewall 14, and has a bottom 16, tub end wall 18, and tub sidewall 20. A conventional tub drain outlet 22 is located in bottom 16. A conventional water control valve 24 and water outlet 26 are mounted on end wall 12.

A conventional vertical drain pipe 28 is located in end wall 12. An inlet port 30 at the upper end of pipe 28 is surrounded by a conventional flange 32 or mounting plate (with center opening 32A) to which conventional overflow plate 34 is secured by screws 36. Overflow plate 34 has a fluid passage 38 at its lower portion.

The overflow plate 34 (FIG. 3) has an inner surface 40 and an outer surface 42. The plate 34 is circular in shape and has an inwardly extending flange 44 on its upper periphery, and a smaller inwardly extending flange 46 on the lower periphery which creates the fluid passage 38 (FIG. 3) when mounted by screw 36.

A second overflow plate 48 is similar but slightly larger than overflow plate 34. Plate 48 is circular in shape and has inner surface 50 and outer surface 52. Plate 48 has an inwardly extending flange 54 on its upper periphery and a smaller inwardly extending flange 56 on its lower periphery which creates a fluid passage 58 when mounted as described below. (FIG. 3).

Figure 4:
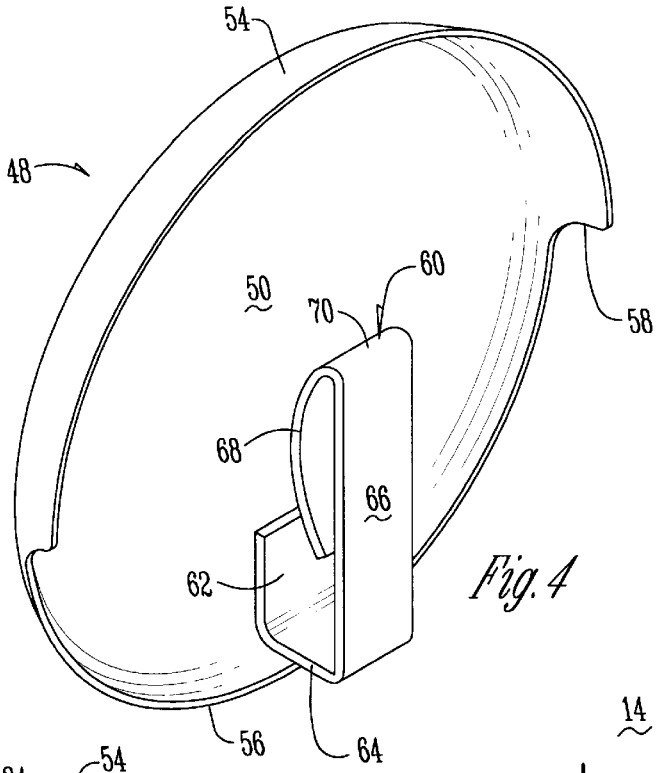
FIG. 4 is an enlarged scale perspective view of the overflow plate showing its inner surface.

A spring clip 60 (FIG. 4) is secured to the inner surface 50 of the outer overflow plate 48. Clip 60 has a vertical potion 62 secured to surface 50, an inwardly extending portion 64; thence an upwardly extending portion 66 which terminates in an outwardly and downwardly extending tab portion 68. The tab 68 is spaced from the inner surface 50. The top 70 of clip 60 is located between portions 66 and 68.

Figure 3:
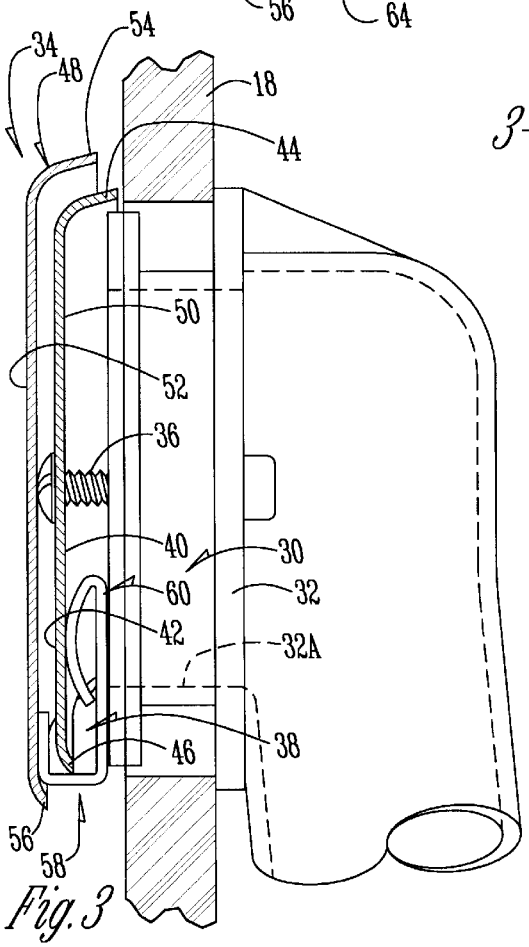
FIG. 3 is an sectional view of the mounting plate assembly taken on line 3—3 of FIG. 2.
Figure 2:
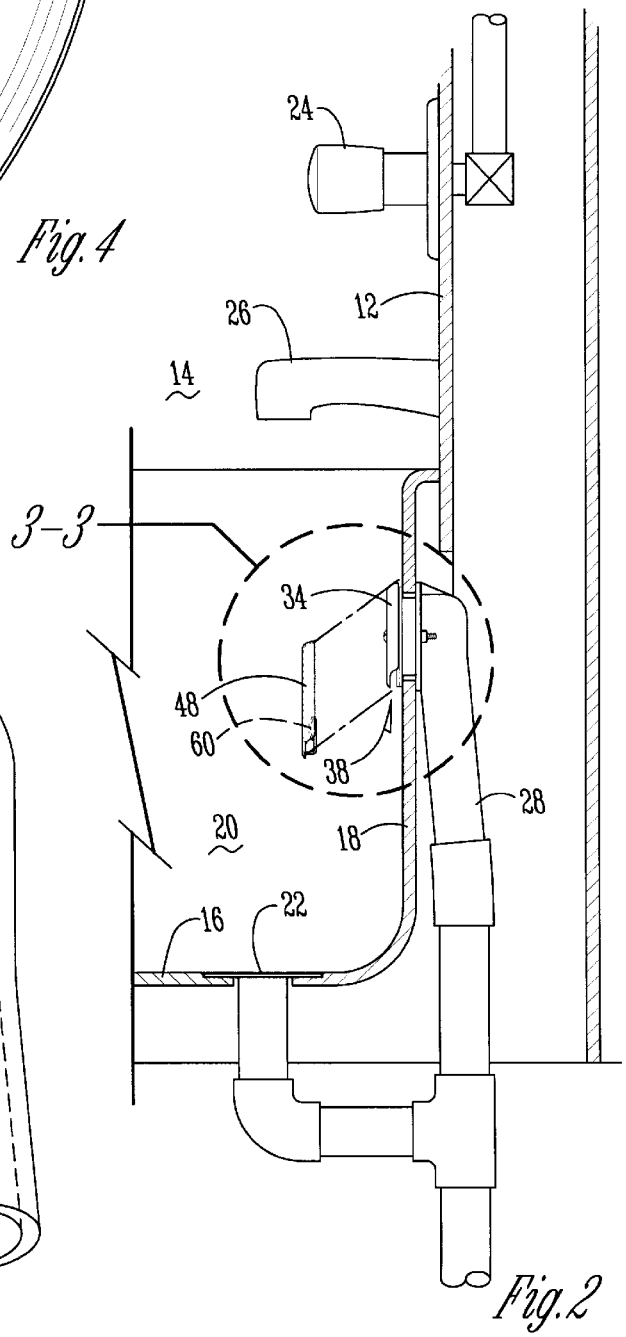
FIG. 2 is an enlarged scale exploded side sectional view taken on line 2—2 of FIG. 1.

To create the assembled parts of FIG. 3, the upper end 70 of spring clip 60 is inserted into the fluid passage 38 of existing overflow plate 34. The overplate 48 is then moved upwardly into a concentric position with existing overflow plate 34 whereupon tab 68 on plate 48 frictionally but forcibly engages the inner surface 40 of existing plate 34. The spring tension on clip 60 causes the tab 68 to deflect but to fritionally engage plate 34 sufficiently to hold plate 48 in position on plate 34.

To remove plate 48 from plate 34, the above procedure is reversed as plate 48 is moved outwardly and downwardly from plate 34.

The plate 48 can be mounted without removing plate 34 and without the use of tabs or screws. It is therefore seen that this invention will achieve at least all of its stated objectives.

What is claimed is:

1. An overflow plate for bathtubs, comprising, a circular overflow plate having inner and outer surfaces, an inwardly curved flange means on a periphery of the plate, a spring clip extending away from the inner surface, the spring clip extending outwardly and thence upwardly in spaced relation to the inner surface and terminating in a downwardly extending tab portion.

2. The overflow plate of claim 1 wherein the tab portion is in spaced relation to the inner surface.

3. An overflow plate assembly for bathtubs, comprising, a vertical mounting plate attached to an inlet port of a vertical drain pipe, a first circular overflow plate positioned adjacent the mounting plate and having an inner surface adjacent the mounting plate, and an outer surface, a fluid passage in a lower portion of the first circular overflow plate;

a second circular overflow plate located concentrically and outwardly of the first circular overflow plate and having an inner surface, and a spring clip on the inner surface of the second circular overflow plate extending into and upwardly through the fluid passage of the first circular overflow plate to frictionally engage the inner surface thereof to removably hold the second first circular overflow plate in concentric relation to the first overflow plate.

4. An overflow plate assembly for bathtubs, comprising, a vertical mounting plate with a center opening attached to an inlet port of a vertical drain pipe, a first circular overflow plate positioned adjacent the mounting plate and having an inner surface adjacent the mounting plate, and an outer surface, a fluid passage in a lower portion of the first circular overflow plate, a second circular overflow plate located concentrically and outwardly of the first circular overflow plate and having an inner surface, and a spring clip means on the second overflow plate frictionally detachably securing the second overflow plate adjacent the outer surface of the first overflow plate and extending into the fluid passage in the first overflow plate.

* * * * *